United States Patent [19]

Harty et al.

[11] Patent Number: 4,645,260

[45] Date of Patent: Feb. 24, 1987

[54] FOLDING CHAIR

[75] Inventors: Alexander Harty, Untersiemau; Jurgen Lange, Stegmuhle, both of Fed. Rep. of Germany

[73] Assignee: Loga Mobel GmbH, Fed. Rep. of Germany

[21] Appl. No.: 676,109

[22] Filed: Nov. 29, 1984

[30] Foreign Application Priority Data

Jan. 13, 1984 [DE] Fed. Rep. of Germany ..... 8400924

[51] Int. Cl.[4] ..... A47C 4/00

[52] U.S. Cl. ..... 297/35; 297/45

[58] Field of Search ..... 297/35, 45, 44, 42

[56] References Cited

U.S. PATENT DOCUMENTS

| | | | |
|---|---|---|---|
| 2,104,255 | 1/1938 | Garbaccio | 297/45 |
| 2,460,459 | 2/1949 | Kraska | 297/44 R |
| 2,591,284 | 4/1952 | Oden | 297/35 |
| 4,243,263 | 1/1981 | Thiboutot | 297/45 |

FOREIGN PATENT DOCUMENTS

| | | | |
|---|---|---|---|
| 261236 | 6/1913 | Fed. Rep. of Germany | 297/35 |
| 286807 | 7/1931 | Italy | 297/35 |
| 215551 | 5/1924 | United Kingdom | 297/45 |
| 666871 | 2/1952 | United Kingdom | 297/45 |

*Primary Examiner*—Francis K. Zugel

*Attorney, Agent, or Firm*—Bacon & Thomas

[57] ABSTRACT

A folding chair defined by an H-shaped front portion and an H-shaped back portion secured together in an articulated manner by a mechanism including a pair of cross strut assemblies, a pair of rear braces, a pair of front braces and a pair of articulated lever linkages, which mechanism permits the chair to be folded into an extremely compact assembly and unfolded into a highly stable position of use. The chair also includes a removable backrest for providing resilient support to the back of the user, a flexible web seat tensioned between the front and back portions and a pair of armrests carried by the lever linkages.

3 Claims, 4 Drawing Figures

FOLDING CHAIR

BACKGROUND OF THE INVENTION

1. Field of the Invention

The present invention generally involves the field of technology pertaining to folding chairs. More particularly, the invention involves an improved folding chair of the type comprised of a back portion and a front portion that are connected to each other and provided with a seat therebetween, and two armrests disposed on either side of the chair and extending between the back and front portions.

2. Description of the Prior Art

It is known to provide chairs which are capable of being folded into a compact configuration for storage and transport purposes. However, conventional folding chairs are characterized by several disadvantages, including complex articulated structures, inability to accommodate the placement of the feet of the user under the seat, the lack of a yieldable back support, difficulty in folding and unfolding with possibility of jamming the articulated structure, instability in the unfolded position of use, and the requirement for substantial storage space in the folded condition.

SUMMARY OF THE INVENTION

It is an object of the present invention to provide an improved folding chair having a simple structural configuration and being capable of providing a high degree of seating comfort.

It is another object of the invention to provide an improved folding chair which may be easily folded and unfolded without the risk of jamming the folding mechanism.

It is a further object of the invention to provide an improved folding chair which is extremely stable in the unfolded position of use and eliminates the possibility of collapsing when the chair is being placed into such position of use.

It is yet another object of the invention to provide an improved folding chair which is extremely compact in its folded position so as to facilitate storage and transport of the folding chair.

These and other objects of the invention are realized by providing a folding chair which is essentially comprised of a back portion and a front portion, each of which being preferably of an H-shaped configuration, for supporting the chair on the ground surface. A seat is disposed between the front and back portions, and two armrests are provided on opposite sides of the seat and extend between the front and back portions. The front and back portions are connected together in an articulated manner on both sides of the seat by a pair of cross strut assemblies, a pair of rear braces, a pair of front braces and a pair of articulated lever linkages, each of the latter serving to support an armrest. The back portion includes a pair of elongate supports which are connected to each other by a pair of parallel crossbars, including an upper crossbar to which the rear braces are connected and a lower crossbar to which the rear edge of the seat is connected. The front portion includes a pair of elongate supports which are connected together by a crossbar to which the front edge of the seat is also secured. The front braces are also connected to the upper ends of the elongate supports forming the front portion. A backrest is provided for removable connection to a pair of inwardly connected studs carried at the upper ends of the back portion, and includes a flexible web stitched between the spring legs of two V-shaped straps. By virtue of this arrangement, the back portion, the front portion and the armrests may be unfolded into an extremely stable position of use or folded against each other in a substantially parallel disposition to provide an extremely compact folded assembly.

Other objects, features and advantages of the invention shall become apparent from the following description and appended claims, reference being made to the accompanying drawings forming a part of the specification, wherein like reference characters designate corresponding parts of the several views.

DETAILED DESCRIPTION OF THE PREFERRED EMBODIMENT

Figure 1:
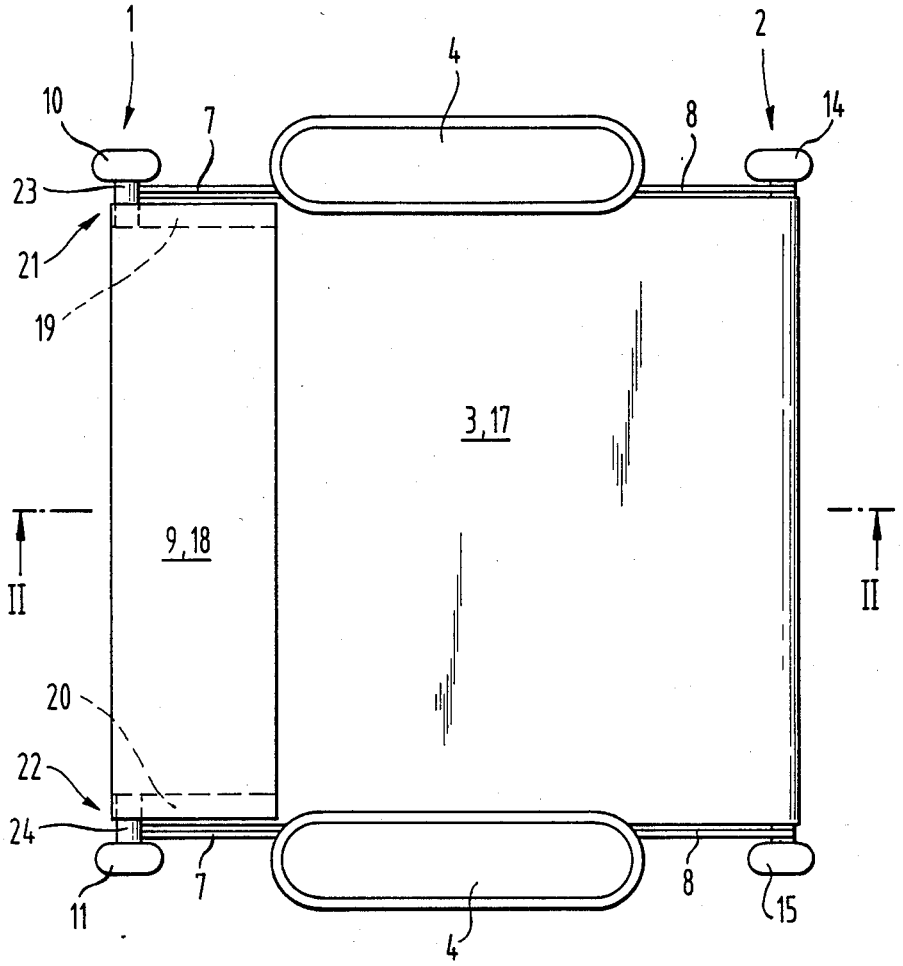
FIG. 1 a top view in schematic representation of a folding chair according to a preferred embodiment of the invention and shown in an unfolded position of use.
Figure 2:
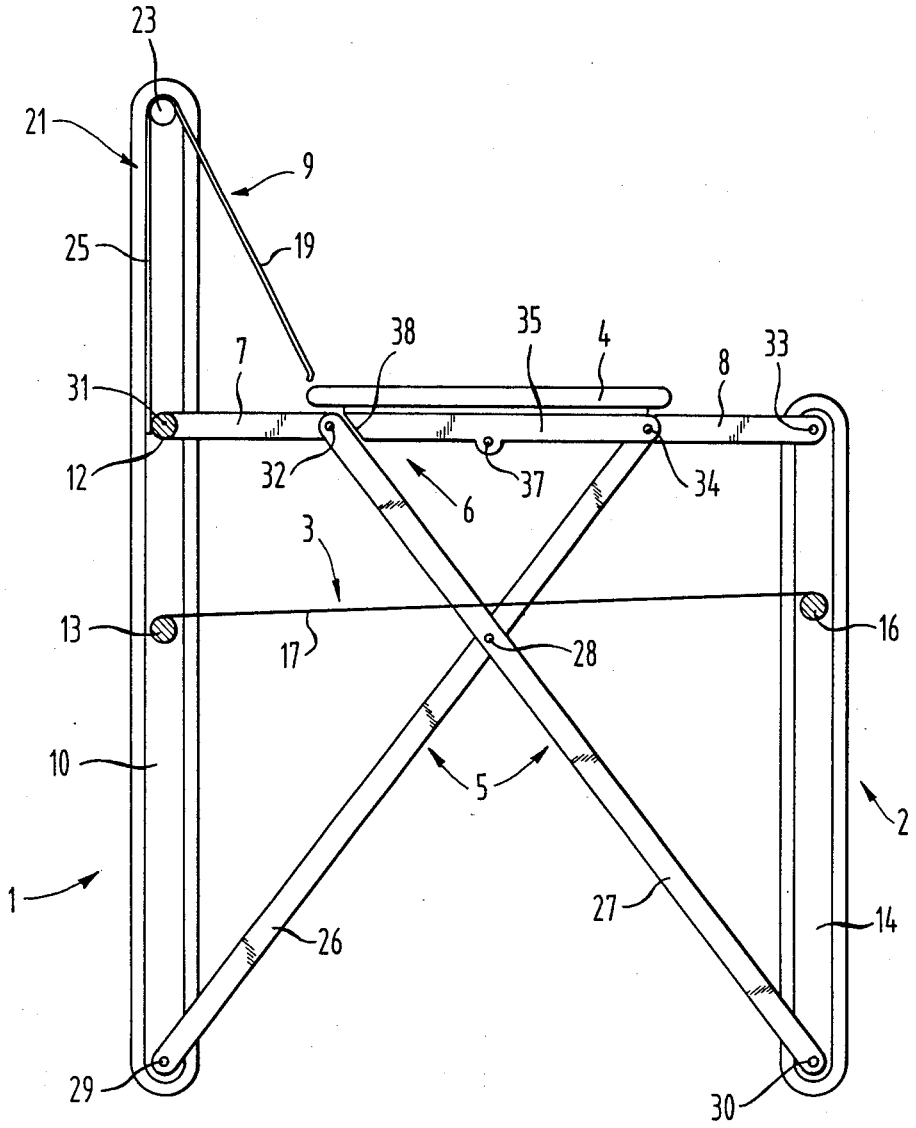
FIG. 2 is a vertical longitudinal sectional view taken on the line II—II of FIG. 1.

With particular reference to FIGS. 1 and 2 of the drawings, there is shown a folding chair according to a preferred embodiment of the invention and comprised of a back portion 1, a front portion 2, a seat 3, and a pair of armrests 4 disposed on either side of seat 3. Back portion 1 and front portion 2 are connected by a pair of articulated mechanisms, each of which includes a cross strut assembly 5, an articulated lever linkage 6, a rear brace 7 and a front brace 8. A backrest 9 is supported on back portion 1.

Back portion 1 is in the form of a flat frame defined by a pair of elongate supports 10 and 11 disposed in parallel and connected to each other by an upper cross-bar 12 and a lower crossbar 13 disposed in parallel. Front portion 2 is also in the form of a flat frame defined by a pair of shorter elongate supports 14 and 15 disposed in parallel and secured together by a single crossbar 16. As is apparent, the overall flat frame configuration defined by each of back portion 1 and front portion 2 is essentially of H-shape.

Seat 3 is supported between back portion 1 and front portion 2, and consists of a flexible web 17 which, when the chair is disposed in a position of use, extends transversely and approximately horizontally between back portion 1 and front portion 2. The rear edge of flexible web 17 is secured to lower crossbar 13 and the front edge of flexible web 17 is secured to crossbar 16.

Backrest 9 consists of a flexible web 18 stretched between a pair of spring legs 19 and 20 of two V-shaped straps 21 and 22, respectively. It is preferred that legs 19 and 20 be taken up in two transverse loops provided at the opposite sides of flexible web 18. Straps 21 and 22 are gripped by a pair of inwardly directed studs 23 and 24, respectively, carried at the upper free ends of elongate supports 10 and 11 of back portion 1. The remaining leg 25 of each strap 21 and 22 is secured to back portion 1 so that spring legs 19 and 20 extend from their corresponding studs 23 and 24 in a downward and oblique direction toward front portion 2, as particularly shown in FIG. 2. Thus, when the chair is placed in an unfolded position of use, backrest 9 provides a softly yielding or resilient support for the back of the user. Prior to folding of the chair to the position shown in FIGS. 3 and 4, backrest 9, together with flexible web 18 and straps 21 and 22, is removed from its position of use on back portion 1.

Each cross strut assembly 5 includes a pair of strut members 26 and 27 of equal length which are secured together for pivotal movement about a common axle 28, the latter being disposed parallel to crossbars 12, 13 and 16. The lower end of each strut member 26 is pivotally connected to the lower end of its corresponding elongate support 10 or 11 by an axle 29. Similarly, the lower end of each strut member 27 is pivotally connected to the lower end of its corresponding elongate support 14 or 15 by a pivotal axle 30. In this way, strut members 26 and 27 of each cross strut assembly 5 are permitted to articulate with respect to the lower ends of back portion 1 and front portion 2. It is understood that cross strut assemblies 5 are disposed on opposite sides of seat 3 and extend substantially between back portion 1 and front portion 2.

The upper ends of strut members 27 are connected in an articulated manner to their corresponding rear braces 7 by a pair of pivotal axles 32. Similarly, the upper ends of strut members 26 are connected in an articulated manner to front braces 8 by a pair of pivotal axles 34. As also apparent in FIG. 2, the rearward ends of rear braces 7 are secured to upper crossbar 12 through a pair of pivotal connections 31, while the front ends of front braces 8 are connected in an articulated manner to the upper ends of elongate supports 14 and 15 by a pair of pivotal axles 33.

Each articulated lever linkage 6 is disposed between the upper ends of its corresponding strut members 26 and 27, as defined by pivotal axles 32 and 34 thereof. The purpose of each linkage 6 is to maintain its associated cross strut assembly 5 in its unfolded position of use as shown in FIGS. 1 and 2. Each linkage 6 includes a longer first strut 35 and a shorter second strut 36 connected together in an articulated manner by a pivotal axle 37. As particularly shown in FIG. 3, strut 36 is also connected to its corresponding rear brace 7 and the upper end of strut member 27 by pivotal axle 32, and strut 35 is connected to its corresponding front brace 8 and the upper end of strut member 26 by pivotal axle 34. As also noted from FIG. 3, pivotal axle 37 is disposed parallel to pivotal axle 28, with pivotal axle 37 being positioned approximately midway between the ends of strut 35. As noted in FIG. 2, each strut 35 carries an armrest 4 on the upper side thereof when the chair is in its unfolded position of use. In the extended or unfolded position of each linkage 6, pivotal axle 37 connecting struts 35 and 36 is disposed beneath the vertical positions of pivotal axles 32 and 34, and between the upper ends of strut members 26 and 27 forming cross strut assembly 5. Each first strut 35 includes a free end 38 which abuts against the upper end of its corresponding strut member 27.

A folding chair constructed in the aforedescribed manner provides an extremely high degree of stability when placed in its unfolded position of use. This stability is maintained not only when a user is actually sitting on the chair, but also when the chair is moved and rearranged. The structural configuration of articulated linkages 6 prevent them from folding when placed in their extended position as shown in FIG. 2, during which they serve to maintain cross strut assemblies 5 in a spread apart position. Under this condition, the upper movement of pivotal axle 37 is counteracted by the tensile stress imposed in flexible web 17 of seat 3. The loading of the folding chair or seat 3, respectively, further increases the force which is imposed against linkages 6 to maintain them in their stable extended or unfolded position as shown in FIG. 2. This froce is proportional to the weight of the user seated on seat 3 and its flexible web 17. In the position of use of the chair as shown in FIGS. 1 and 2, rear braces 7, struts 35 and front braces 8 are disposed in substantially horizontal straight lines that extend along each side of the chair, so that armrests 4 carried by struts 35 are also disposed approximately horizontal.

MODE OF OPERATION

Figure 3:
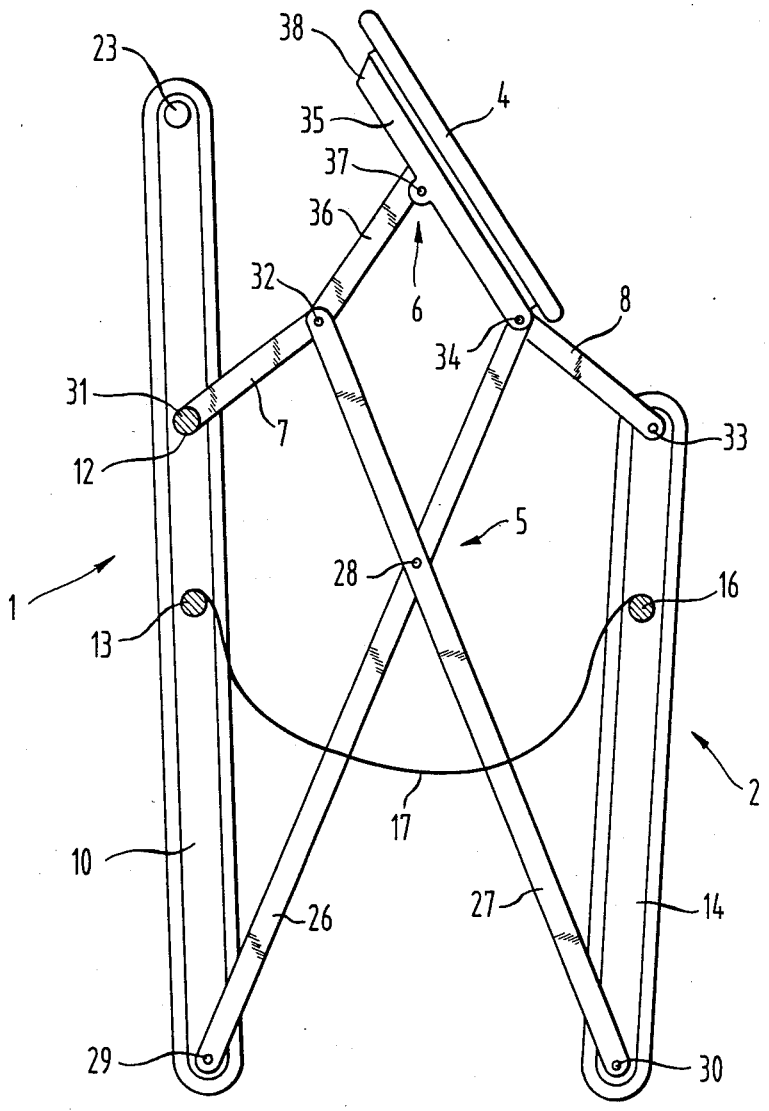
FIG. 3 is a vertical view of the chair as shown in FIG. 2, with the backrest removed and the chair being disposed in an intermediate folded position.

The operation of the folding chair according to the invention shall now be described with particular reference to FIGS. 2, 3 and 4. Assuming the chair is in its unfolded position of use as shown in FIG. 2, folding of the chair is first accomplished by removing backrest 9 from its position on back portion 1. The user then grips armrests 4 and pulls them in the upward direction, thereby causing struts 35 to move upwardly about their pivotal axles 34. This causes linkages 6 to fold, wherein each strut 36 is caused to pivot about axle 37 and brought towards its corresponding strut 35. When this occurs, the tensile stress in flexible web 17 of seat 3 is overcome, a condition evidenced by the disposition of axles 32, 37 and 34 along a substantially common straight line. Continued movement of axle 37 in the upward direction causes continued decrease in the tensile stress of flexible web 17, with the consequent articulation of back portion 1, front portion 2 and armrests 4 toward each other in the intermediate forward position shown in FIG. 3. Further folding of the chair in this manner thereby results in the completely folded position shown in FIG. 4. In this latter condition, the maximum width of the folded chair is approximately equal to the double widths of the elongate supports 10, 11, 14 and 15.

Figure 4:
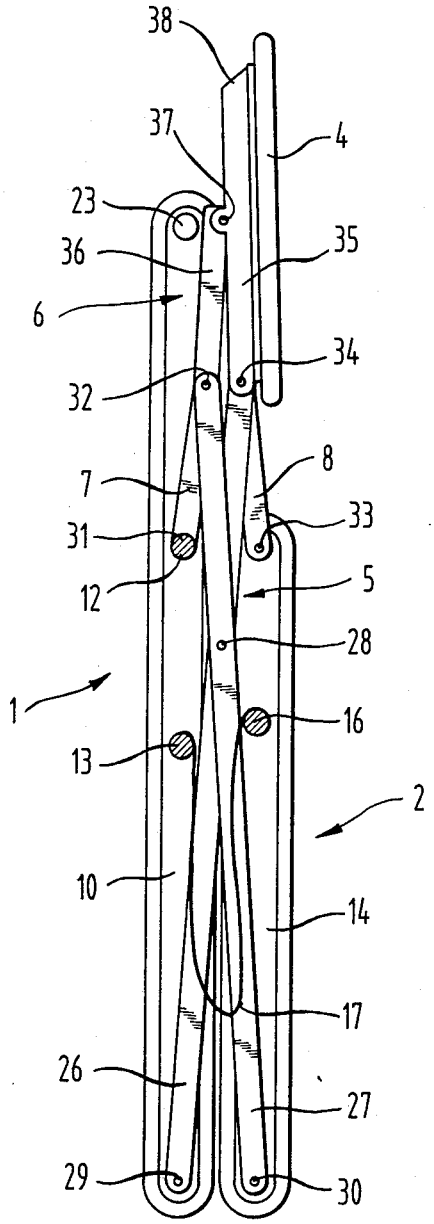
FIG. 4 is a vertical view of the chair shown in FIG. 3, wherein the chair has been placed in a completely folded position with the back portion, front portion and armrests being disposed substantially in parallel with each other.

The unfolding of the chair from the folded position shown in FIG. 4 to the unfolded position of use shown in FIG. 2 is accomplished in a similar but reverse manner from that previously described. In this case, flexible web 17 of seat 3 is caused to be placed under tensile stress by the spreading apart of back portion 1 and front portion 2 through the downward travel of axle 37 to a position between and below axles 32 and 34. This places the chair in a stable position which is evidenced by the articulated mechanism audibly locking into position. Because of the described mechanism, there is minimum risk of jamming of the chair during its folding and unfolding, thereby providing a distinct advantage over conventional folding chair mechanisms. The unfolded chair is completed by assembling backrest 9 onto the upper end of back portion 1 in the manner previously described.

In the position of use shown in FIGS. 1 and 2, the chair according to the invention is extremely comfortable to the user. The H-shaped configuration of front portion 2 permits the feet of the user to be placed under seat 3 without hindrance. Backrest 9 constitutes a highly comfortable support for the back of the user because of its soft and yielding resiliency, and prevents the user from contacting any of the struts or crossbars forming back portion 1.

It is apparent that the folding chair according to the invention is characterized by a very simple configuration comprised of a relatively few uncomplicated structural elements. While the two V-shaped straps 21 and 22 are preferably made of spring steel and the two flexible webs 17 and 18 are preferably made of a textile material, the other structural elements, aside from the pivotal axles, may be formed of wood, synthetic plastic or other materials deemed suitable for the practice of the invention as disclosed herein. The pivotal axles are preferably of metal or other suitable material capable of performing the required functions described herein.

It is to be understood that the embodiment of the invention herein shown and described is to be taken as a preferred example of the same, and that various changes in the shapes, sizes, arrangement of parts, compositions and methods of use and operation may be resorted to, without departing from the spirit of the invention or scope of the subjoined claims.

We claim:

1. An improved folding chair of the type including a back portion and a front portion connected to each other and provided with a seat and a pair of armrests extending between the back and front portions, which chair comprises:

(a) a pair of cross strut assemblies connecting the back and front portions together for articulation between an unfolded position of use and a folded position, each cross strut assembly comprising:
  (i) an elongate front strut member;
  (ii) an elongate rear strut member;
  (iii) means to pivotally connect the front and rear strut members together between their opposite ends;

(b) a pair of rear braces pivotally connected to the back portion at first pivot points;

(c) a pair of front braces pivotally connected to the front portion at second pivot points;

(d) means pivotally connecting the front strut members of the cross strut assemblies to both the rear brace at third pivot points and to the front portion;

(e) means pivotally connecting the rear strut members of the cross strut assemblies to both the front braces at fourth pivot points and the back portion such that the first, second, third and fourth pivot points lie in a common plane when the cross-strut assemblies are in the unfolded position of use;

(f) a flexible web defining a seat of the chair connected at opposed edges only to the back and front portions so as to extend therebetween below the plane containing the first through fourth pivot points;

(g) a pair of articulated linkages, each linkage including first and second elongate struts, wherein the first strut is longer than the second strut, has a free end and supports an armrest;

(h) means pivotally connecting an end of each second strut to both a corresponding rear brace and a corresponding front strut member;

(i) means pivotally connecting an end of each first strut to both a corresponding rear strut member and a corresponding front brace; and (j) means pivotally connecting an end of the second strut to the approximate mid-point of the first strut to define a common pivotal axis such that by pressing down the armrest, the articulated linkages apply pressure to spread the strut members of the cross strut assemblies and the front and rear braces apart and subjecting the flexible web to tensile stress and maintain the chair in a stable, unfolded position of use in which the free ends of the first struts engage with the front strut members and wherein the common pivotal axis is located below the plane of the first through fourth pivot points and between the third and fourth pivot points.

2. The chair of claim 1 further comprising:

(a) a back portion of a substantially H-shaped configuration defined by a pair of elongate supports and a pair of parallel upper and lower cross bars;

(b) a front portion of a substantially H-shaped configuration defined by a pair of elongate supports and a single cross bar;

(c) means to secure the flexible web to the lower cross bar of the back portion and the single cross bar of the front portion; and (d) means to pivotally secure the rear braces to the upper cross bar of the back portion.

3. The chair of claim 2 wherein the elongate supports of the back portion exceed in height the elongate supports of the front portion when the chair is disposed in its unfolded position of use, and further including a removable backrest carried by the back portion between the elongate supports thereof wherein the backrest comprises:

(a) a pair of spaced V-shaped straps connected to each other by a flexible web, the V-shaped straps being formed of spring steel, with each strap including a first spring leg which is engaged by the flexible web and extends obliquely and downwardly towards the front portion when the chair is placed in its unfolded position of use, and a second spring leg secured to the back portion; and (b) a pair of inwardly directed studs mounted on the upper ends of the back portions so as to engage the V-shaped straps of the backrest.

* * * * *